US006126397A

United States Patent [19]

Kvasnak et al.

[11] Patent Number: 6,126,397

[45] Date of Patent: Oct. 3, 2000

[54] TRAILING EDGE COOLING APPARATUS FOR A GAS TURBINE AIRFOIL

[75] Inventors: William S. Kvasnak, Palm Beach Gardens, Fla.; Ronald S. LaFleur, Pottsdam, N.Y.

[73] Assignee: United Technologies Corporation, Hartford, Conn.

[21] Appl. No.: 09/218,873

[22] Filed: Dec. 22, 1998

[51] Int. Cl.[7] ..... F01D 5/18

[52] U.S. Cl. ..... 416/97 R; 415/115

[58] Field of Search ..... 415/115; 416/97 A, 416/97 R, 96 R

[56] References Cited

U.S. PATENT DOCUMENTS

| | | | |
|---|---|---|---|
| 3,700,418 | 10/1972 | Mayeda | 416/97 A |
| 4,293,275 | 10/1981 | Kobayashi et al. | 416/97 R |
| 5,342,172 | 8/1994 | Coudray et al. | 416/97 R |
| 5,378,108 | 1/1995 | Zelesky | 416/97 R |
| 5,392,515 | 2/1995 | Auxier et al. | 416/97 R |
| 5,403,159 | 4/1995 | Green et al. | 416/97 R |
| 5,486,093 | 1/1996 | Auxier et al. | 416/97 R |
| 5,498,133 | 3/1996 | Lee | 416/97 R |
| 6,004,100 | 12/1999 | Przirembel et al. | 416/97 R |

*Primary Examiner*—Edward K. Look
*Assistant Examiner*—Richard Woo
*Attorney, Agent, or Firm*—Ronald G. Cummings; Richard D. Getz

[57] ABSTRACT

A coolable airfoil is disclosed which includes an internal cavity, an external wall, a plurality of first apertures, and a plurality of second apertures. The external wall includes a suction-side portion and a pressure-side portion. The external wall portions extend chordwise between a leading edge and a trailing edge, and spanwise between an inner radial surface and an outer radial surface. The mean camber line of the airfoil passes through the leading edge and the trailing edge along a path equidistant between the outer surfaces of the pressure-side and suction-side walls. The first apertures, which are disposed in the external wall adjacent the trailing edge, extend a distance within the suction-side wall portion and exit the external wall through the pressure-side wall portion. The second apertures extend through the pressure-side wall portion and exit the pressure-side wall portion upstream of and in close proximity to the first apertures.

6 Claims, 1 Drawing Sheet

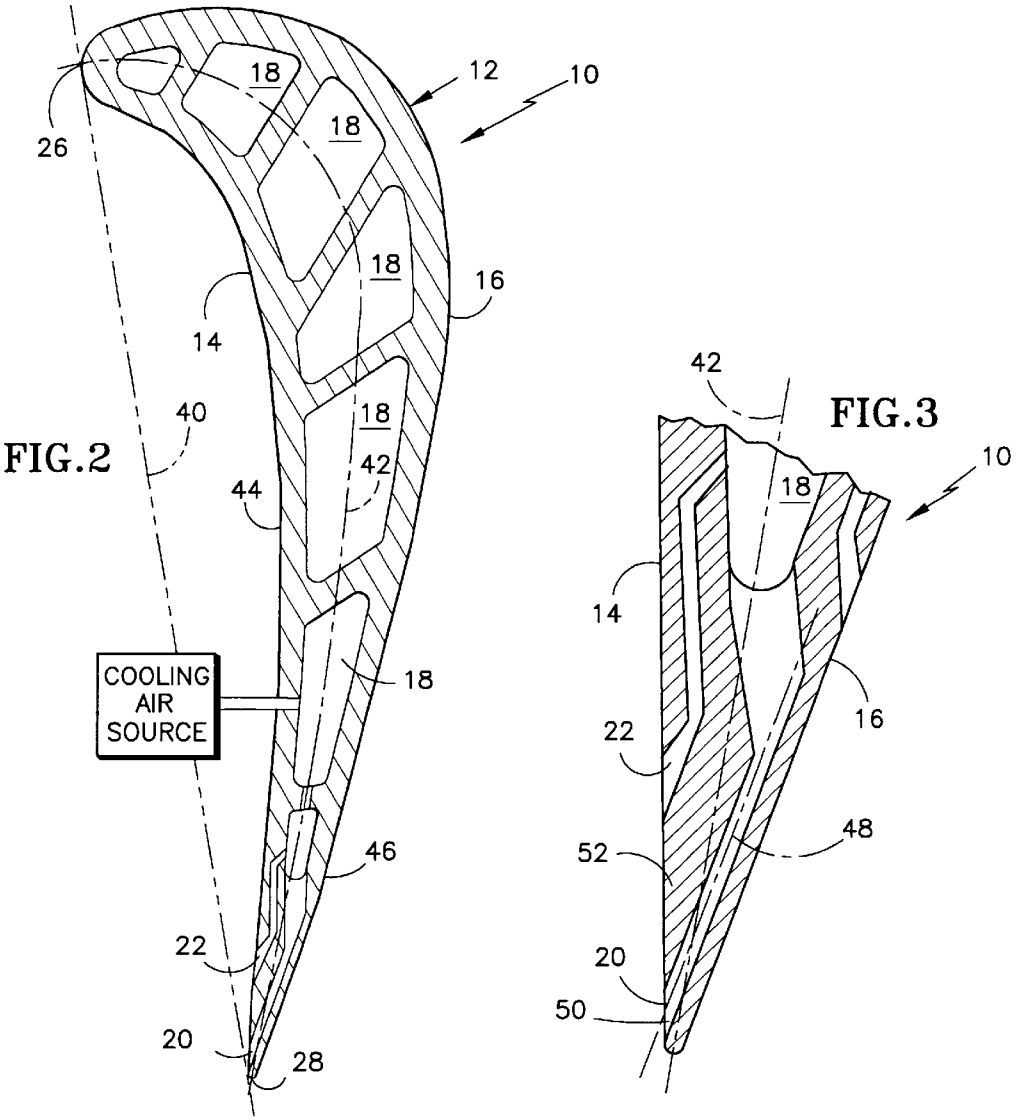
FIG. 2
FIG. 3
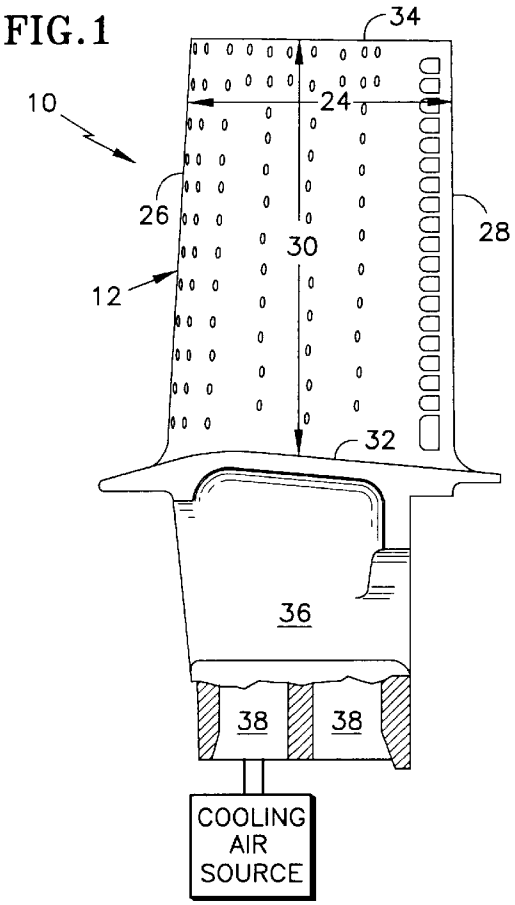
FIG. 1

TRAILING EDGE COOLING APPARATUS FOR A GAS TURBINE AIRFOIL

The Government has rights in this invention, pursuant to Contract No. F33615-95-C-2503 (5.1.1072) awarded by the Department of the Air Force.

TECHNICAL FIELD

This invention relates to hollow airfoils in general, and to trailing edge cooling hole configurations in particular.

BACKGROUND OF THE INVENTION

In modern axial gas turbine engines, turbine rotor blades and stator vanes require extensive cooling. A typical rotor blade or stator vane airfoil includes a serpentine arrangement of passages connected to a cooling air source, such as the compressor. Air bled from the compressor provides a favorable cooling medium because its pressure is higher and temperature lower than the core gas traveling through the turbine; the higher pressure forces the compressor air through the passages within the component and the lower temperature transfers heat away from the component.

In conventional airfoils, the cooling air exits the airfoil via cooling holes disposed, for example, along both sides of the leading edge or disposed in the pressure-side wall along the trailing edge. Cooling is particularly critical along the trailing edge, where the airfoil narrows considerably. Most airfoil designs include a line of closely packed cooling holes in the exterior surface of the pressure-side wall, distributed along the entire span of the airfoil. A relatively small pressure drop across each of the closely packed holes encourages cooling air exiting the holes to form a boundary layer of cooling air (film cooling) aft of the holes that helps cool and protect the aerodynamically desirable narrow trailing edge.

Conventional pressure-side trailing edge cooling schemes represent a trade-off between cooling flow and mechanical durability. The narrow cross-section of the airfoil makes it impractical to cool the trailing edge via an internal cavity adjacent the trailing edge. In place of the cavity it is known to extend diffused cooling holes through the pressure-side of the external wall upstream of the trailing edge. The size and number of conventional cooling holes reflects the cooling air flow necessary to cool the trailing edge. The practical size and number of the cooling holes is limited, however, by the thickness of the airfoil wall. If the diffused cooling holes are positioned too close, the airfoil trailing edge becomes undesirably thin and consequently susceptible to mechanical fatigue. To avoid the fatigue, the diffused cooling holes are moved forward and spaced apart. Film cooling effectiveness, however, is inversely related to the distance traveled by the film.

What is needed is an airfoil with trailing edge cooling apparatus with improved cooling and one with improved resistance to mechanical fatigue.

SUMMARY OF THE INVENTION

It is an object of the invention to provide an airfoil with improved cooling along its trailing edge.

Another object of the invention is to provide an airfoil with improved resistance to mechanical fatigue.

Other objects will be in part apparent and in part pointed out more in detail hereinafter.

Accordingly, it has been found that the foregoing and related objects are attained in a coolable airfoil having an internal cavity, an external wall, a plurality of first apertures, and a plurality of second apertures. The external wall includes a suction-side portion and a pressure-side portion. The external wall portions extend chordwise between a leading edge and a trailing edge, and spanwise between an inner radial surface and an outer radial surface. The mean camber line of the airfoil passes through the leading edge and the trailing edge along a path equidistant between the outer surfaces of the pressure-side and suction-side walls. The first apertures, which are disposed in the external wall adjacent the trailing edge, extend a distance within the suction-side wall portion and exit the external wall through the pressure-side wall portion. The second apertures extend through the pressure-side wall portion and exit the pressure-side wall portion upstream of and in close proximity to the first apertures.

An advantage of the present invention is that cooling along the trailing edge is improved. Conventional cooling schemes typically provide trailing edge cooling via diffused apertures biased toward the pressure-side of the airfoil. Because the suction-side wall adjacent the diffused cooling holes has a constant thickness in a conventional scheme, the cooling holes break through the pressure-side wall a distance away from the trailing edge. The diffused geometry of each conventional hole extends aft thereby encouraging cooling air exiting the cooling holes to form a boundary layer of cooling air along the pressure-side wall portion. The distance between the cooling apertures and the trailing edge is typically great enough such that the trailing edge region is not appreciably affected by convective cooling resulting from cooling air traveling through the cooling apertures. Rather, the trailing edge is dependent on the efficiency of the boundary layer cooling. A second problem associated with the above described conventional trailing edge cooling configuration is that the thickness of the suction-side wall adjacent the cooling apertures minimizes the effectiveness of the convective cooling within the suction-side wall portion. This is particularly true in the region aft of the cooling apertures. In the present invention, the first apertures are biased toward the suction-side wall. The consequent position of the first apertures provides a suction-side wall portion that is typically thinner than that of a conventional airfoil, and an exit position within the pressure-side wall portion that is closer to the trailing edge than that of a conventional airfoil. As a result, the first apertures provide better convective cooling within the suction-side wall portion and better trailing edge cooling. In addition, the shift of the first apertures toward the suction-side wall portion leaves more wall material in the pressure-side wall. That additional material makes it possible to position a row of second apertures within the pressure-side wall portion upstream of and in close proximity to the first apertures. The row of second apertures provides boundary layer cooling between the rows of first and second cooling apertures. The cooling air traveling aft of the row of second cooling apertures also augments the cooling along the trailing edge.

Another advantage of the present is that it avoids the stress risers associated with conventional trailing edge cooling schemes, and thereby minimizes the opportunity for mechanical fatigue. In conventional trailing edge cooling schemes, the cooling apertures are typically coupled with diffusers which extend aft toward the trailing edge. The diffusers decrease the amount of wall material in the narrow trailing edge and consequently increase the opportunity for mechanical fatigue.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a diagrammatic drawing of a rotor blade.

FIG. 2 is a diagrammatic sectional of an airfoil.

FIG. 3 is an enlarged view of the present invention trailing edge cooling configuration.

DESCRIPTION OF THE PREFERRED EMBODIMENT

Although specific forms of the present invention have been selected for illustration in the drawings, and the following description is drawn in specific terms for the purpose of describing these forms of the invention, the description is not intended to limit the scope of the invention which is defined in the appended claims.

Referring to FIGS. 1 and 2, a coolable airfoil 10 for gas turbine engine includes an external wall 12 which includes a pressure-side portion 14 and a suction-side portion 16, an internal cavity 18 disposed between the pressure-side and suction-side wall portions 14, 16, a plurality of first cooling apertures 20, and a plurality of second cooling apertures 22. The internal cavities 18 are connected to a source of cooling air. The pressure-side and suction-side wall portions 14, 16 extend widthwise 24 between a leading edge 26 and a trailing edge 28, and spanwise 30 between an inner radial platform 32 and an outer radial surface 34. The exemplary airfoil 10 shown in FIG. 1 is a portion of a rotor blade having a root 36 with cooling air inlets 38. An airfoil 10 acting as a stator vane may also embody the present invention. FIG. 2 shows a cross-section of an airfoil 10 (stator vane or rotor blade) embodying the present invention, having a plurality of internal cavities 18, connected to one another in a serpentine manner.

Referring to FIG. 2, the airfoil 10 may be described in terms of a chordline 40 and a mean camber line 42. The chordline 40 extends between the leading edge 26 and the trailing edge 28. The mean camber line 42 extends between the leading edge 26 and the trailing edge 28 along a path equidistant between the outer surface 44 of the pressure-side wall portion 14 and the outer surface 46 of the suction-side wall portion 16. If the airfoil 10 is symmetrical about the chordline 40, the chordline 40 and the mean camber line 42 coincide. If the airfoil 10 is unsymmetrical about the chordline 40 (as can be seen in FIG. 2), the mean camber line 42 intersects the chordline 40 at the leading edge 26 and trailing edge 28, and deviates therebetween.

Referring to FIG. 3, the plurality of first apertures 20 are disposed in the external wall 12 adjacent the trailing edge 28. In specific terms, the centerline 48 of each first aperture 20 is disposed on the suction-side of the mean camber line 42 for a portion of the length of the first aperture 20, and preferably for more than half of its length. The aft portion 50 of each first aperture 20 extends over the mean camber line 42 and into the pressure-side wall portion 14, subsequently exiting through the pressureside wall portion 14. The plurality of second apertures 22 extend through the pressure-side wall portion 14, exiting the pressure-side wall portion 14 upstream of and in close proximity to the first apertures 20. In some embodiments, the first and second apertures 20, 22 extend adjacent one another aft of the internal cavity 18.

In the operation of the airfoil 10, cooling air within the internal cavity 18 at a pressure higher and temperature lower than the core gas flow passing the exterior of the airfoil 10 enters both the first and second cooling apertures 20, 22. Cooling air entering the first apertures 20 convectively cools the suction-side wall portion 16 adjacent the trailing edge 28. The convective cooling of the suction-side wall portion 16 is improved relative to conventional trailing edge cooling schemes because the first apertures 20 are biased toward the suction-side wall portion 16 (thereby decreasing the wall thickness), whereas cooling apertures in conventional trailing edge cooling schemes are biased toward the pressure-side wall portion 14 (not shown).

Biasing the first cooling apertures 20 toward the suction-side wall portion 16 increases the material of the pressure-side wall portion 14 relative to the amount of wall material that would be in the pressure-side wall portion 14 in a convention trailing edge cooling scheme. As a result it is possible to position a row of second apertures 22 upstream of, and in close proximity to, the row of first apertures 20 exiting the pressure-side wall portion 14. The cooling air passing through the second apertures 22 convectively cools the pressure-side wall portion 14 surrounding the second apertures 22. The cooling air exiting the second apertures 22 establishes film cooling aft of the second apertures 22, in the region 52 between the rows of first and second apertures 20, 22. The combination of the first and second apertures 20, 22 increases the cooling within the pressure-side and suction-side wall portions 14, 16 adjacent the trailing edge 28, and therefore the ability of the trailing edge 28 to withstand a harsh thermal environment. In addition, the combination of the first and second apertures 20, 22 avoids the film cooling effectiveness problem and consequent trailing edge 28 thermal distress. The positioning of the first apertures 20 in close proximity to the trailing edge 28 and the upstream cooling augmentation provided via the second apertures 22 provides improved cooling relative to conventional cooling schemes.

As will be apparent to persons skilled in the art, various modifications and adaptations of the structure above-described will become readily apparent without departure from the spirit and scope of the invention, the scope of which is defined in the appended claims.

What is claimed is:

1. A coolable airfoil having a chordline and a mean camber line, said airfoil comprising:

an internal cavity;

an external wall, which includes a suction-side portion disposed on a first side of said mean camber line and a pressure-side portion disposed on a second side of said mean camber line opposite said first side, wherein said portions extend chordwise between a leading edge and a trailing edge and spanwise between an inner radial surface and an outer radial surface;

a plurality of first apertures, disposed in said external wall adjacent said trailing edge, wherein said a first section of each said first aperture extends a distance within said suction-side portion of said wall and a second section of each said first aperture extends across said mean camber line and exits said external wall through said pressure-side portion of said wall;

a plurality of second apertures, extending through said pressure-side portion of said wall and exiting said pressure-side portion of said wall upstream of and in close proximity to said first apertures.

2. The coolable airfoil according to claim 1 wherein said airfoil is cambered.

3. The coolable airfoil according to claim 1 wherein each said first aperture extends a distance at least equal to half of its length within said suction-side portion of said wall.

4. The coolable airfoil according to claim 1 wherein said second apertures are diffused and wherein cooling air exiting said second apertures establishes film cooling between said first and second apertures.

5. The coolable airfoil according to claim 1 wherein a portion of each said second aperture extends within said external wall adjacent said first apertures.

6. A coolable airfoil having a chordline and a mean camber line, said airfoil comprising:

an external wall, which includes a suction-side portion disposed on a first side of said mean camber line and a pressure-side portion disposed on a second side of said mean camber line opposite said first side, wherein said portions extend chordwise between a leading edge and a trailing edge and spanwise between an inner radial surface and an outer radial surface;

an internal cavity disposed adjacent said trailing edge;

a plurality of first apertures disposed in said external wall between said internal cavity and said trailing edge, wherein said first apertures extend a distance within said suction-side portion of said wall and exit said external wall through said pressure-side portion of said wall;

a plurality of second apertures extending through said pressure-side portion of said wall and exiting said pressure-side portion of said wall, each said second aperture having a portion disposed in said pressure side portion of said wall between said internal cavity and said trailing edge.

* * * * *